US006027109A

United States Patent [19]

Wada et al.

[11] Patent Number: 6,027,109

[45] Date of Patent: Feb. 22, 2000

[54] DOCUMENT FEEDER

[75] Inventors: Hiroshi Wada, Osaka; Mitsuharu Yoshimoto, Nara-ken; Sinji Yamamoto; Tadahiro Kiyosumi, both of Osaka; Junichi Inada, Miyazaki-ken; Susumu Hanano, Osaka; Takeshi Sakaguchi, Osaka; Susumu Takehara, Osaka, all of Japan

[73] Assignee: Mita Industrial Co., Ltd., Osaka, Japan

[21] Appl. No.: 08/968,088

[22] Filed: Nov. 12, 1997

[30] Foreign Application Priority Data

Nov. 15, 1996 [JP] Japan ..... 8-304643

[51] Int. Cl.[7] ..... B65H 5/22

[52] U.S. Cl. ..... 271/3.14; 271/4.01; 271/4.04; 399/110; 399/367

[58] Field of Search ..... 271/3.14, 4.01, 271/4.04; 399/110, 367

[56] References Cited

U.S. PATENT DOCUMENTS 5,078,377 1/1992 DuBois ..... 271/4.01

5,338,018 8/1994 Nagao et al. ..... 399/367

5,534,989 7/1996 Rubscha et al. ..... 271/3.14

*Primary Examiner*—William E. Terrell

*Assistant Examiner*—Mark Deuble

*Attorney, Agent, or Firm*—Smith, Gambrell & Russell

[57] ABSTRACT

A document feeder to be mounted atop an image reading device having a stationary optical system disposed under a contact glass. The document feeder includes a document original plate for holding thereon document originals, a document original feeding mechanism for feeding a document original from the document original plate onto a contact glass, a document original transporting mechanism for transporting the document original fed by the document original feeding mechanism along the upper surface of the contact glass, a document original discharging mechanism for discharging the document original transported by the document original transporting mechanism, and a document original discharge plate for receiving the document original discharged by the document original discharging mechanism. The document original feeding mechanism, the document original transporting mechanism and the document original discharging mechanism are integrally supported in a unit body to constitute a single unit.

11 Claims, 9 Drawing Sheets

DOCUMENT FEEDER

BACKGROUND OF THE INVENTION

1. Field of the Invention

The present invention relates to a document feeder for use in a copying machine or the like and, more particularly, to a document feeder to be rested atop an image reading device having a stationary optical system disposed under a contact glass of a copying machine, and adapted to transport a document original along the upper surface of the contact glass thereby allowing the image reading device to read (or browse) an image of the document original. Such a document feeder may comprise a document original plate for holding thereon a document original, a document original feeding mechanism for feeding the document original onto the contact glass from the document original plate, a document original transporting mechanism for transporting the document original fed by the document original feeding mechanism along the upper surface of the contact glass, a document original discharging mechanism for discharging the document original transported by the document original transporting mechanism, and a document original discharge plate for receiving the document original discharged by the document original discharging mechanism, which may all be provided on the image reading device.

2. Description of Related Art

Some imaging apparatuses, for example, digital copying machines, digital facsimiles and digital image readers employ an image reading device adapted to read an image of a document original being transported along the upper surface of a contact glass by means of a stationary optical system disposed under the contact glass. Since such a browse-type image reading device is adapted to read an image of a document original during transportation of the document original, a driving unit for the optical system can be dispensed with. This allows for size reduction of the contact glass. Further, this provides another merit that the components of the document feeder rested atop the image reading device can be made compact, particularly, for size reduction of a document original transporting section for transporting the document original along the upper surface of the contact glass as well as a document original feeding section and a document original discharging section respectively provided upstream and downstream of the document original transporting section.

The document original transporting section, the document original feeding section, the document original discharging section and the like are mounted one on another on the image reading device for assembling thereof. Therefore, the mounting positions of the respective components must be adjusted on a component-by-component basis. This leads to a difficulty in precise positioning, and requires a time-consuming positioning operation and a troublesome maintenance operation.

It is important to precisely align the optical system disposed below the contact glass with the document feeder disposed above the contact glass in the image reading device. The accuracy of the alignment is a critical factor which decides the degree of integrity of an image to be acquired by the image reading device.

SUMMARY OF THE INVENTION

It is therefore an object of the present invention to provide a document feeder featuring easy and precise positioning thereof in the assembling thereof.

It is another object of the invention to provide a document feeder featuring easy maintenance thereof.

The document feeder according to the present invention comprises a document original plate for holding thereon a document original, a document original feeding mechanism for feeding the document original from the document original plate onto a contact glass, a document original transporting mechanism for transporting the document original fed by the document original feeding mechanism along the upper surface of the contact glass, a document original discharging mechanism for discharging the document original transported by the document original transporting mechanism, a document original discharge plate for receiving the document original discharged by the document original discharging mechanism, and a unit body for integrally supporting the document original feeding mechanism, the document original transporting mechanism and the document original discharging mechanism in the form of a single unit.

According to the invention, the document original feeding mechanism, the document original transporting mechanism and the document original discharging mechanism may be integrated as a single unit. Once these mechanisms are properly positioned relative to each other when assembled into the unit, the mounting of the unit on the image reading device can be achieved simply by properly positioning the unit relative to the image reading device. Thus, the mechanisms to be assembled can readily and precisely be positioned relative to the upper surface of the contact glass.

It is preferred that the aforesaid unit body is constructed to be detachable from the document feeder. This allows the operating portions including the document original feeding mechanism, the document original transporting mechanism and the document original discharging mechanism to be removed as a single unit from the document feeder, thereby ensuring easy maintenance.

A base is preferably provided on the image reading device for positioning the unit body in a parallel direction with respect to the surface of the contact glass.

This ensures easy and precise positioning of the unit body with respect to the upper surface of the contact glass.

In this case, the base and the document original discharge plate may be integrally formed. The unit body preferably further includes an abutment portion adapted to abut against the upper surface of the contact glass for positioning the unit body in a direction perpendicular to the surface of the contact glass.

The foregoing and other objects, features and effects of the present invention will become more apparent from the following description of the preferred embodiments thereof with reference to the attached drawings.

DESCRIPTION OF THE PREFERRED EMBODIMENTS

Figure 2:
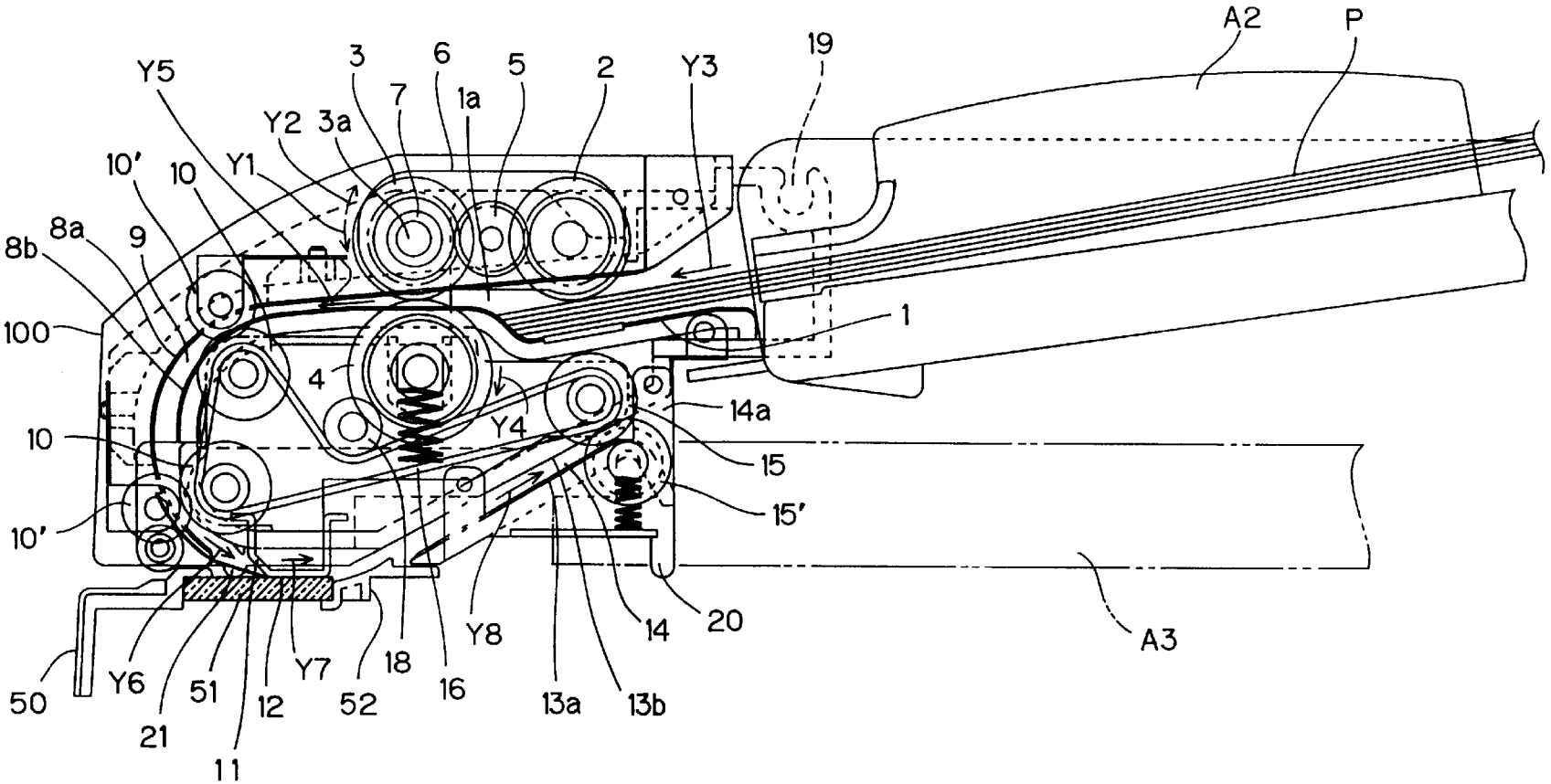
FIG. 2 is a sectional view of a document original transporting unit.
Figure 3A:
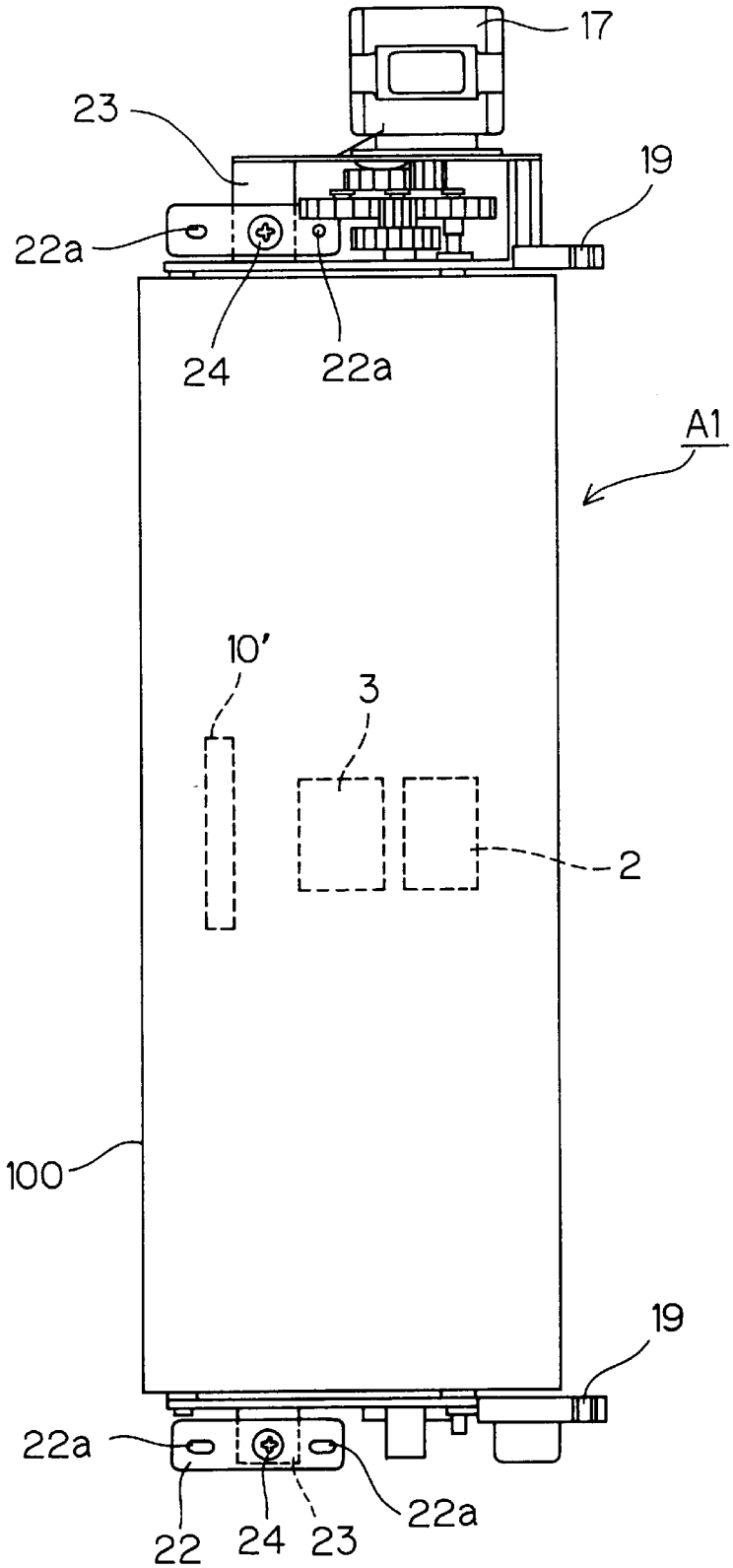
FIGS. 3A and 3B are a plan view and a side view, respectively, which illustrate the document original transporting unit.
Figure 3B:
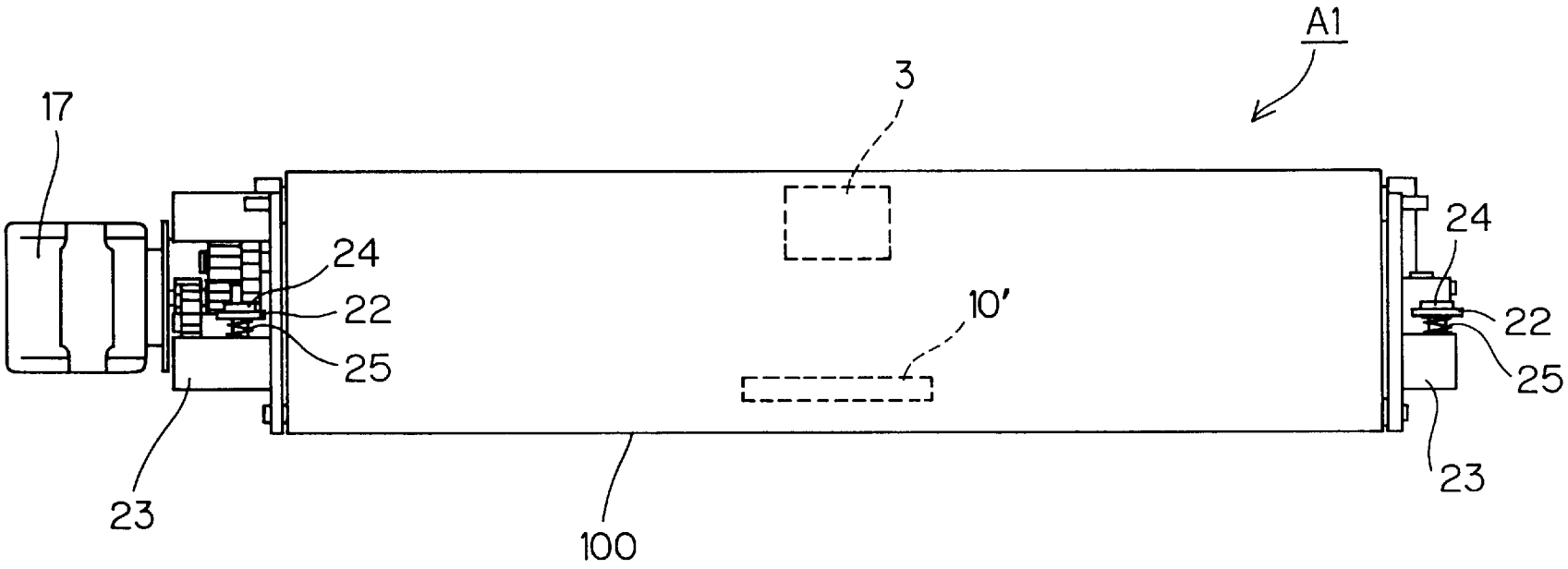
Figure 4A:
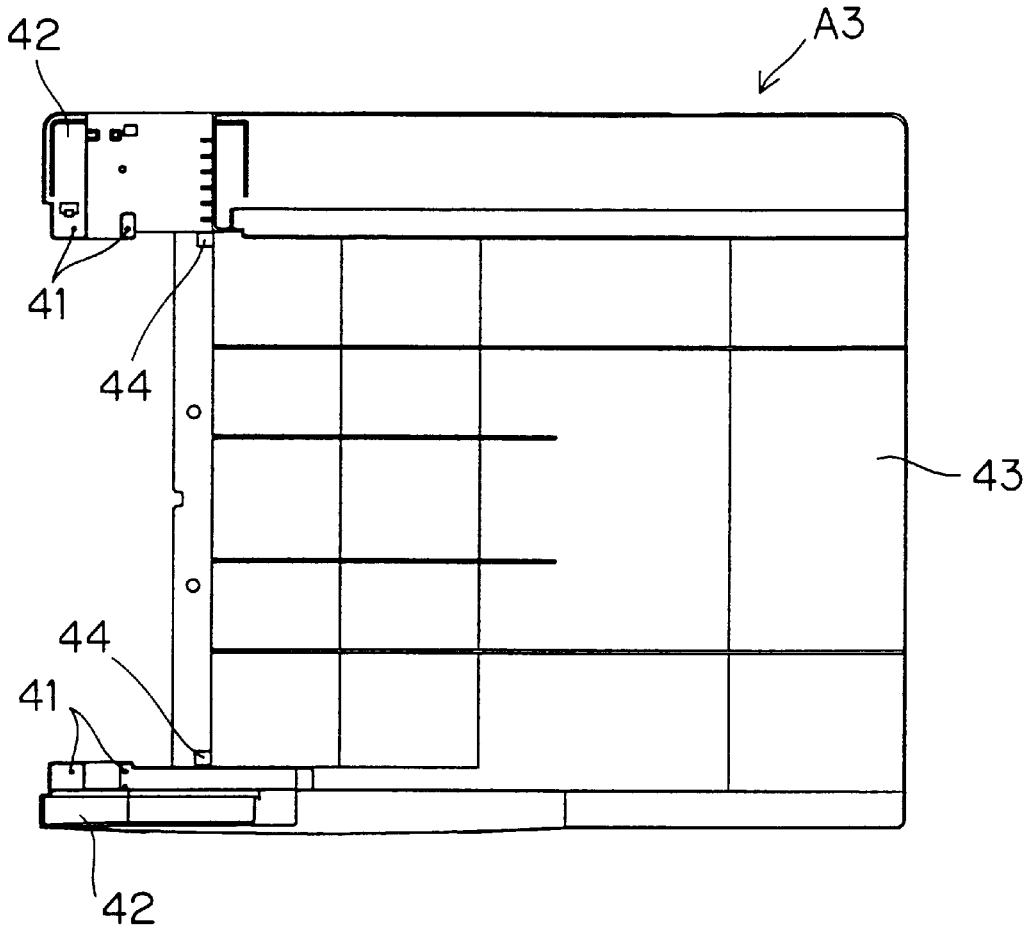
FIGS. 4A, 4B, 4C and 4D are a plan view, a front view, a side view and a rear view, respectively, which illustrate a document original discharge tray.
Figure 4B:
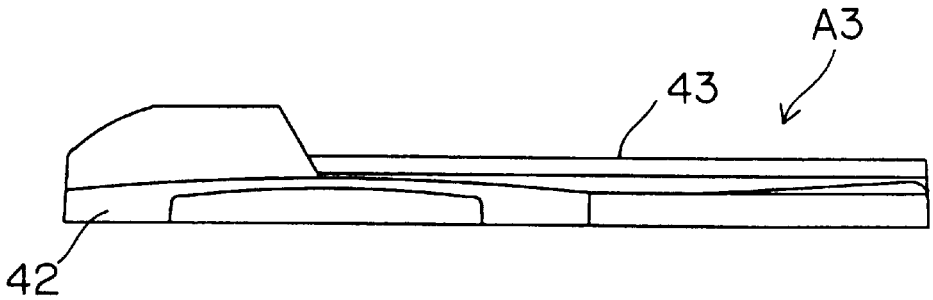
Figure 4C:
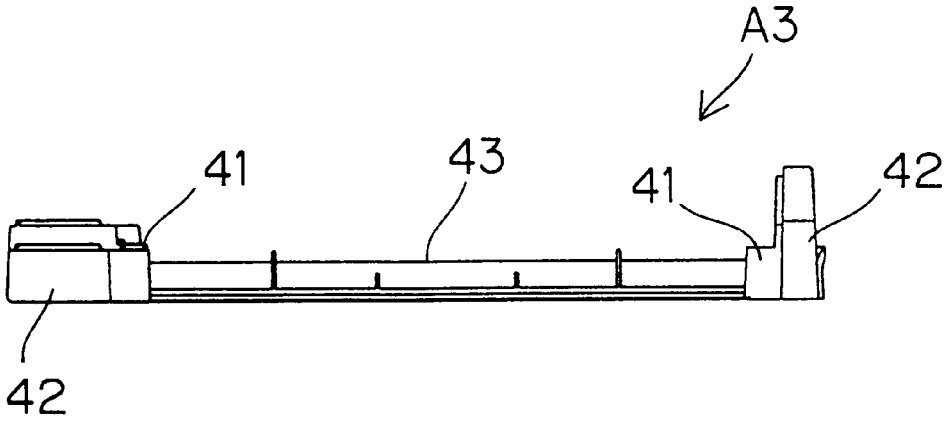
Figure 4D:
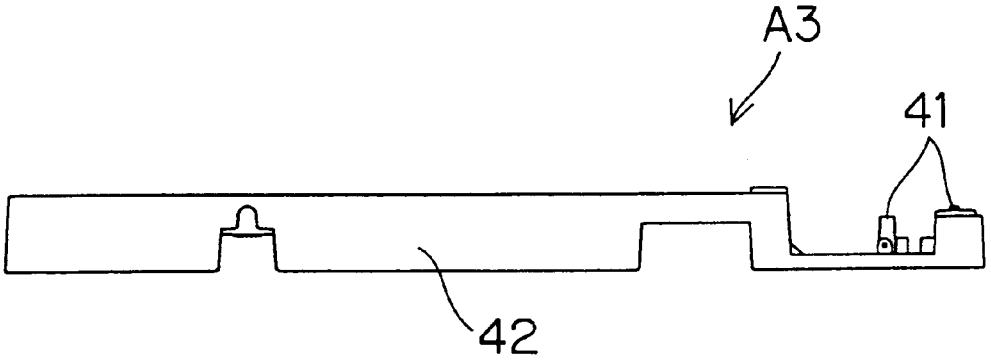
Figure 5:
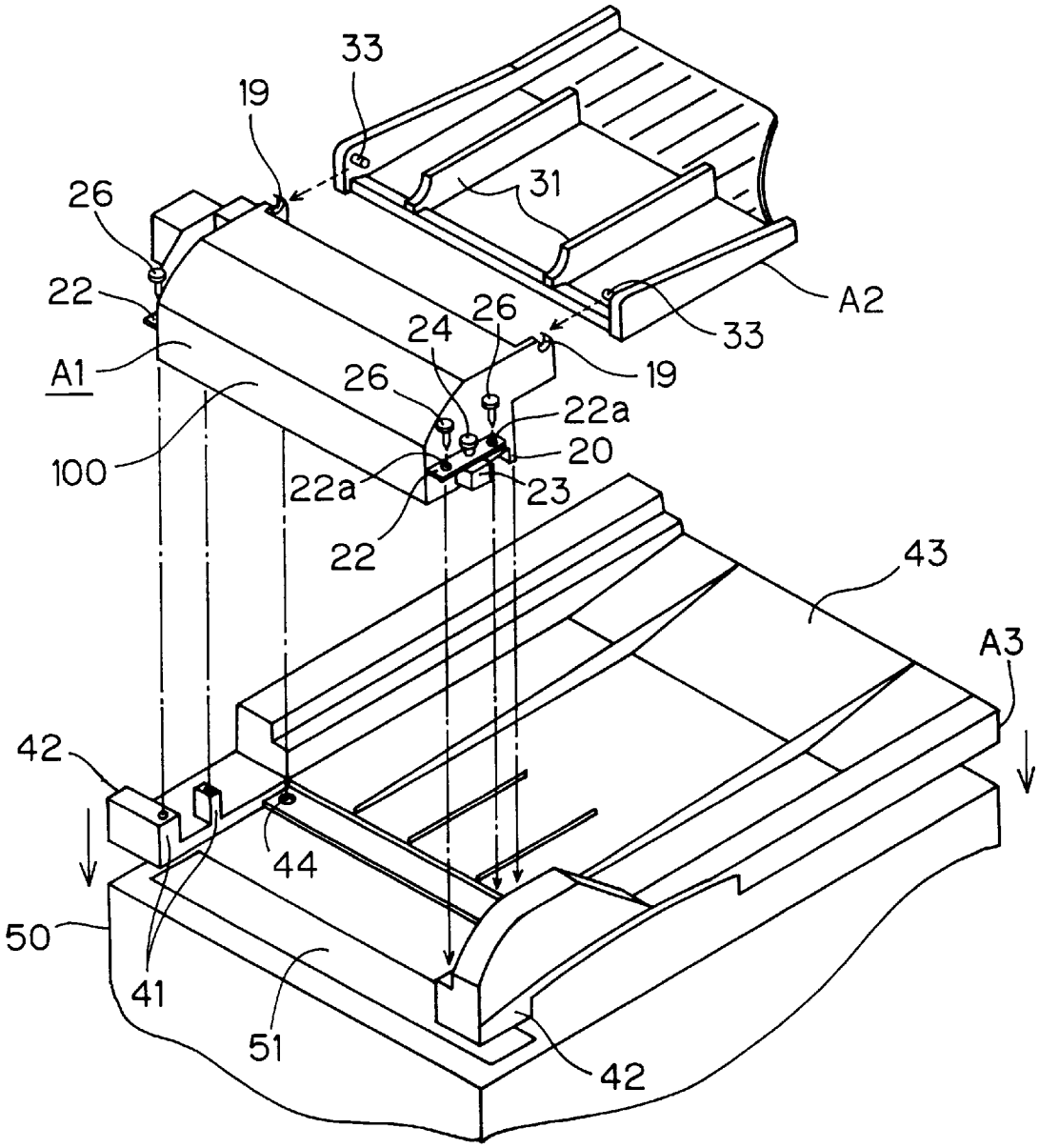
FIG. 5 is a diagram illustrating the assembling and mounting of the document feeder.
Figure 6:
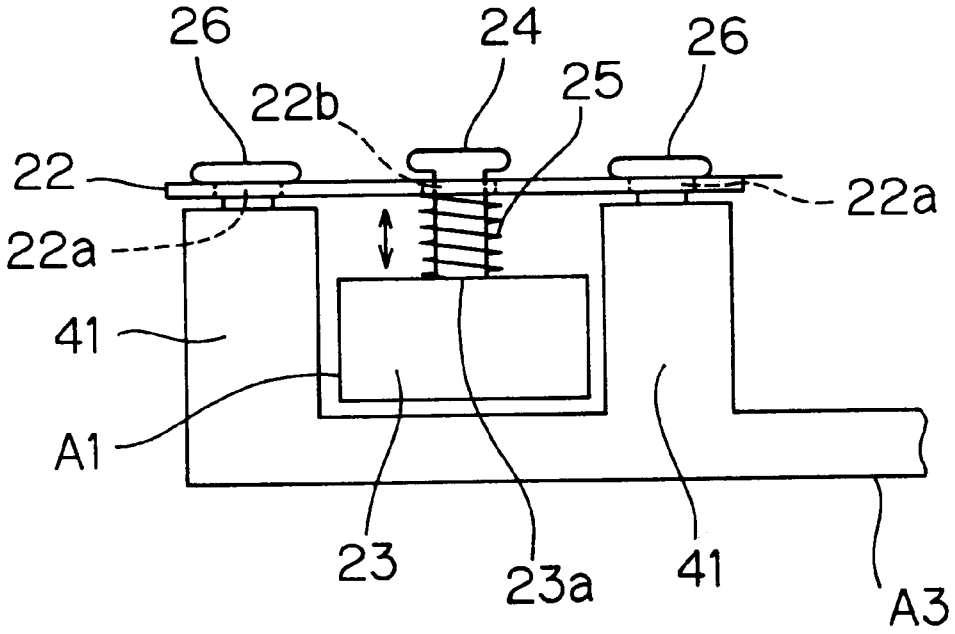
FIG. 6 is a diagram illustrating an attachment construction for attaching the document original transporting unit to the document original discharge tray.

Figs. 1A, 1B, 1C and 1D are a plan view, a front view, a side view and a rear view, respectively, which schematically illustrate the construction of a document feeder A according to an embodiment of the invention. FIG. 1E is a plan view of a document original tray A2. FIG. 2 is a sectional view of a document original transporting unit A1, whereas FIGS. 3A and 3B are a plan view and a side view, respectively, which illustrate the document original transporting unit A1. FIGS. 4A, 4B 4C and 4D are a plan view, a front view, a side view and a rear view, respectively, which illustrate a document original discharge tray A3. FIG. 5 is a diagram illustrating the assembling and mounting of the document feeder A, whereas FIG. 6 is a diagram illustrating an attachment construction for attaching the document original transporting unit A1 to the document original discharge tray A3.

Figure 1A:
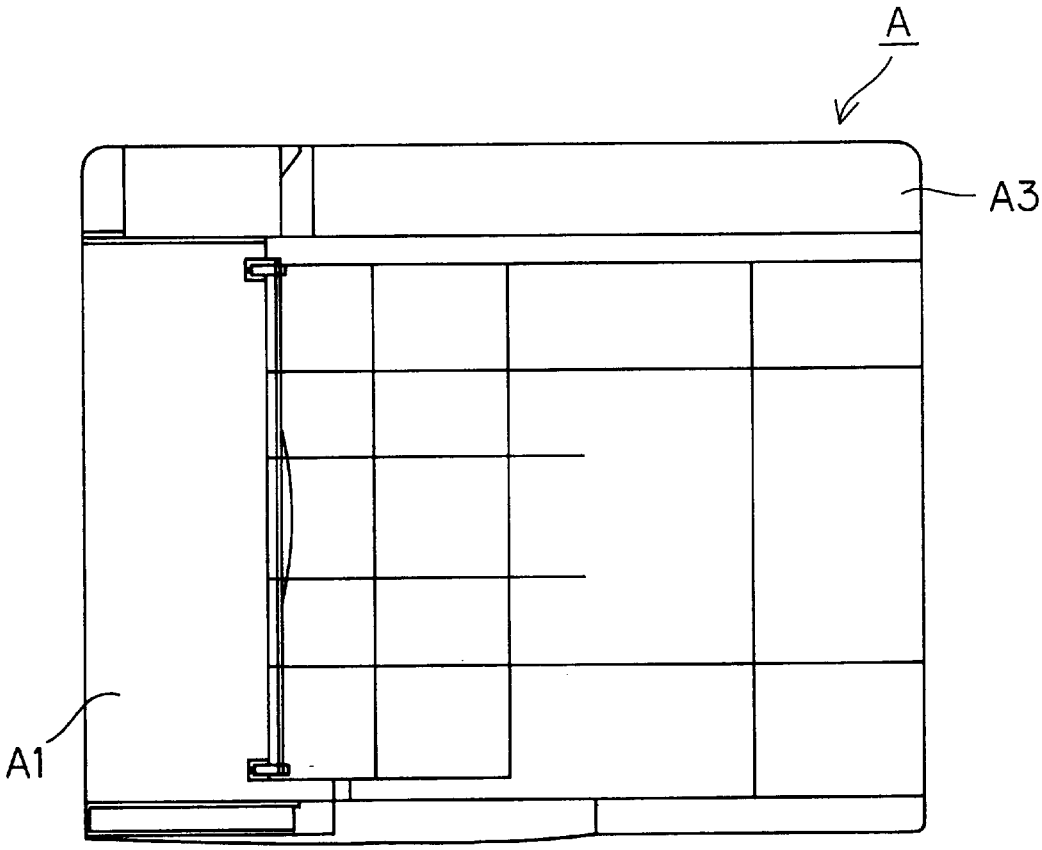
FIGS. 1A, 1B, 1C and 1D are a plan view, a front view, a side view and a rear view, respectively, which schematically illustrate the construction of a document feeder according to an embodiment of the invention.
Figure 1B:
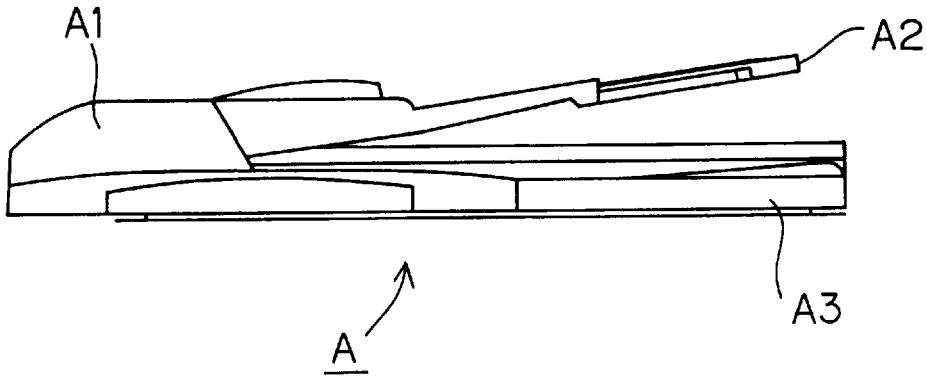
Figure 1C:
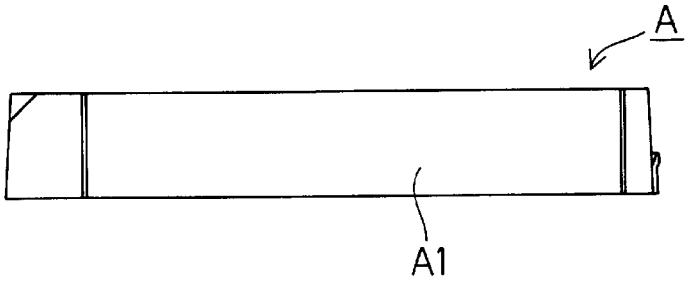
Figure 1D:
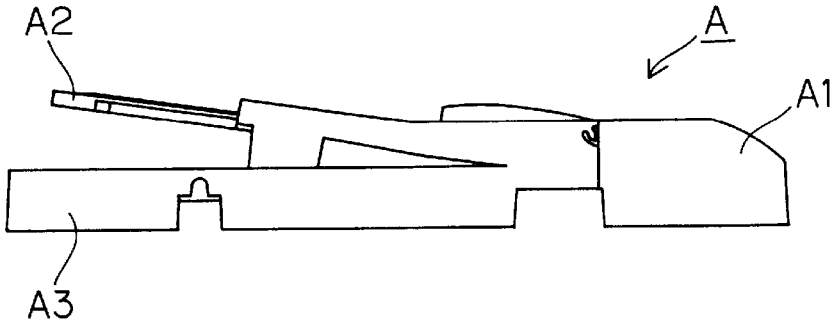
Figure 1E:
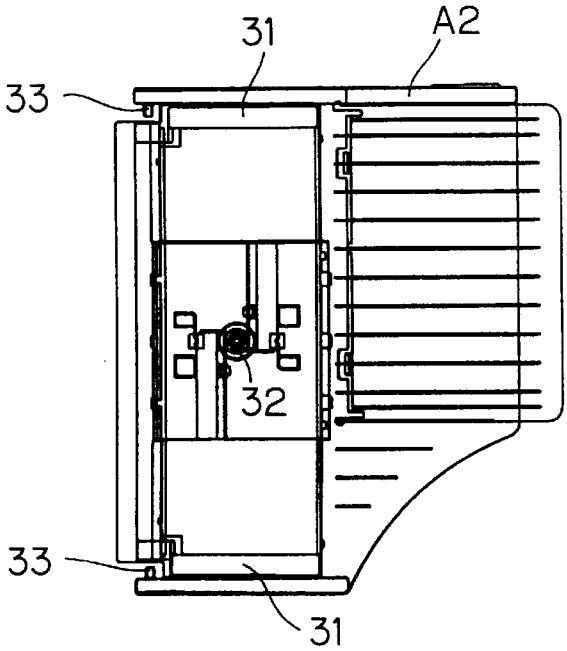
FIG. 1E is a plan view of a document original tray.

As shown in Figs. 1A to 1E, the document feeder A according to the embodiment comprises three units including the document original transporting unit A1, the document original tray A2 and the document original discharge tray A3 (the plan view of FIG. 1A showing a state where the document original tray A2 is removed). The document feeder A is mounted on an image reading device 50 (see FIG. 2) in a digital copying machine.

The document original tray A2 has a construction as shown in the plan view of FIG. 1E. Provided on the document original tray A2 are a pair of width-regulating members 31 for regulating the widthwise position of a document original. The pair of width-regulating members 31 are geared to each other by a gear member 32, and adapted to move toward and away from each other along the width of the document original, while keeping their parallel relation.

In order to attach the document original tray A2 to the document original transporting unit A1, projections 33 formed at opposite ends of the tray are brought into engagement with engaging portions 19 (see FIG. 2) formed in the document original transporting unit A1.

The document original discharge tray A3 has a construction as shown in FIGS. 4A to 4D. The document original discharge tray A3 has a tray portion 43 for receiving a document original discharged from the document original transporting unit A1, and a base 42 for supporting the document original transporting unit A1 in parallel to a surface of a contact glass. The tray and the base are integrally formed in one piece. The document original transporting unit A1 is supported parallel to the contact glass surface with its opposite ends supported by means of fixing portions 41 provided on the base 42. Projections 20 (see FIG. 2) formed on the bottom face of the document original transporting unit A1 are inserted through holes 44 formed in the document original discharge tray A3 to abut against the top surface of the image reading device 50. The document original discharge tray A3 is mounted on the image reading device 50 with the document original transporting unit A1 attached thereto.

The document original transporting unit A1 delivers a document original from the document original tray A2 to the contact glass 51 (see FIG. 2) fixed atop the image reading device 50, and transports the document original along the upper surface of the contact glass 51. Then, the document original transporting unit A1 discharges onto the document original discharge tray A3 the document original thus transported along the upper surface of the contact glass 51. The document original transporting unit A1 comprises a single unit body incorporating all the mechanisms for performing a series of operations described above.

Referring to FIGS. 2, 3A and 3B, description will be made on the schematic construction of the document original transporting unit A1 and its document original transporting operation.

The document original transporting unit A1 is mounted on the contact glass 51 disposed above the image reading device 50 in the digital copying machine (the mounting thereof will be described later). The document original transporting unit A1 has the engaging portions 19 formed at opposite ends of an upper right edge thereof. The document original tray A2 is removably attached to the document original transporting unit A1 by way of its projections 33 engaged with the engaging portions 19 of the document original transporting unit A1.

A document original support plate 1 for supporting the leading edge of a document original P placed on the document original tray A2 is provided in a position adjacent to the leading edge of the document P. A forward feeding roller 2 is disposed above the document original support plate 1 in a vertically movable manner. A feeding port 1*a* of a document original feeding path 9 for guiding the document original P to the vicinity of the contact glass 51 is provided downstream of the forward feeding roller 2 in the document original feeding direction (in the leftward direction as seen in FIG. 2). A delivery roller 3 and a separator roller 4 are provided adjacent to the feeding port 1*a* to define a small gap therebetween.

The forward feeding roller 2 and the delivery roller 3 are coupled to each other by means of a gear 5 to be co-directionally rotated in synchronism. Further, the forward feeding roller 2 and the delivery roller 3 are coupled to each other by means of a lever 6 which is attached pivotally about the center 3*a* of rotation of the delivery roller 3 in a vertical plane. The delivery roller 3 is further provided with a one-way clutch 7 for transferring the rotation of the delivery roller 3 to the lever 6 only when the delivery roller 3 is rotated in the direction of the arrow Y1. The rotation of the delivery roller 3 in the direction of the arrow Y1 causes the lever 6 to pivot about the center 3*a* of rotation in the direction of the arrow Y1, thereby elevating the forward feeding roller 2. When the delivery roller 3 is rotated in the direction of the arrow Y2, the forward feeding roller 2 descends by gravity.

The document original feeding path 9 is defined by document original guides 8*a* and 8*b* which extend from the feeding port 1*a* of the document original support plate 1 to the upper surface of the contact glass 51. Two transportation rollers 10,10 and their assist rollers 10',10' are provided in the document original feeding path 9. A document original pressing member 11 is provided above the contact glass 51 to be opposed to the upper surface of the contact glass 51. The document original pressing member 11 is resiliently biased downward with a small gap (document original transportation path 12) defined between the upper surface of the contact glass 51 and the member 11.

A guide member 52 is disposed downstream of the contact glass 51 in the document original transportation direction (in the rightward direction as seen in FIG. 2) on the image reading device 50, and defines a slope along which the document original is guided in an upwardly slanting direction. The guide member 52 is followed by a document original discharging path 14 defined between document original guides 13*a* and 13*b*. A discharge roller 15 and its assist roller 15' are disposed in the document original discharging path 14. A discharge port 14*a* is provided at a downstream end of the document original discharging path 14, and the document original discharge tray A3 is disposed downstream of the discharge port 14*a* in the document original transportation direction.

The transportation rollers 10,10 and the discharge roller 15 are driven by a torque transferred via a belt 16 from a drive roller 18 driven by a motor 17. Similarly, all the other drive rollers including the delivery roller 3 and the like are driven by the driving force of the motor 17 via transfer mechanisms not shown.

Pairs of projections 20 and 21 are formed on front and rear edge portions of the bottom of the unit body 100 of the document original transporting unit A1 (as viewed in a direction perpendicular to the paper face of FIG. 2). The projections 20 and 21 abut against the top surface of the image reading device 50 and the upper surface of the contact glass 51, respectively, to support the document original transporting unit A1, thereby positioning the unit A1 in the vertical direction with respect to the contact glass 51. Support portions 23 each having a screw hole 23*a* to be used for mounting the document original transporting unit A1 on the document original discharge tray A3 are provided on the front and rear sides of the body 100 of the document original transporting unit A1.

All the components of the document original transporting unit A1 are directly or indirectly supported by the unit body 100 in an integral manner. The plural rollers 2, 3, 10 and 15 disposed in a spaced relation along the document original transportation path extending from the feeding port 1*a* to the discharge port 14*a* constitute the document original feeding mechanism, the document original transporting mechanism and the document original discharging mechanism, which are incorporated in the single document original transporting unit A1.

Next, an explanation will be given to the document original transporting operation to be performed by the document original transporting unit A1 having the aforesaid construction.

First, a stack of document originals P are set on the document original support plate 1 and the document original tray A2 with the leading edges thereof abutting against the feeding port 1*a*. Prior to this, the lever 6 is pivoted counterclockwise, as seen in FIG. 2, by the torque of the delivery roller 3 applied thereto via the one-way clutch 7. When the document originals P are set, therefore, the forward feeding roller 2 is retracted to the upper position so as not to interfere with the setting of the document originals P.

Upon pressing a copy button (not shown) subsequent to the setting of the document originals P on the document original support plate 1, the delivery roller 3 is rotated in the direction of the arrow Y2 with the forward feeding roller 2 geared thereto for co-directional rotation. At the same time, the rotating forward feeding roller 2 descends by gravity to come into contact with the upper surface of the uppermost document original of the stack, thereby advancing the uppermost document original P in the direction of the arrow Y3. At this time, a friction between document originals may cause the uppermost document original to draw out underlying document originals in the direction of the arrow Y3. However, the separator roller 4 rotating in the direction of the arrow Y4 pushes back the underlying document originals so that only the uppermost document original is transported in the direction of the arrow Y5 into the document original feeding path 9 by the delivery roller 3 rotating in the direction of the arrow Y2. If only the uppermost document original is led to the separator roller 4, the separator roller 4 is caused to stop rotation by means of a torque limiter associated therewith, while the uppermost document original is being conveyed by the delivery roller 3.

The document original P introduced into the document original feeding path 9 by the delivery roller 3 is transported in the direction of the arrow Y6 in the document original feeding path 9 by the two transportation rollers 10,10, so that the leading edge thereof enters the document original transportation path 12 defined by the gap between the contact glass 51 and the document original pressing member 11 and further advances in the direction of the arrow Y7. While the document original P is transported along the document original transportation path 12, an image of the document original P is read by a stationary optical reading system disposed under the contact glass 51.

The document original P transported through the document original transportation path 12 is guided in the direction of the arrow Y8 into the document original discharging path 14 by the guide member 52, and then discharged from the discharge port 14*a* onto the document original discharge tray A3 by means of the discharge roller 15.

Next, description will be made on how to assemble the respective units of the aforesaid constructions and on how to mount the units on the document reading device 50.

As shown in FIG. 5, the document original transporting unit A1 is first attached to the document original discharge tray A3 by securing the support portions 23 formed on the opposite sides thereof to the fixing portions 41 of the document original discharge tray A3 by way of attachment members 22 and fixing screws 26. FIG. 6 illustrates the attachment construction in detail.

Support members 24 are respectively fitted through holes 22*b* of the attachment members 22 and are screwed into the support portions 23 of the document original transporting unit A1. Compression coil springs 25 (biasing mechanisms) are respectively fitted around the support members 24 between the support portions 23 and the attachment members 22. Therefore, the document original transporting unit A1 integral with the support portions 23 is vertically suspended on the attachment members 22. On the other hand, the document original transporting unit A1 integral with the support portions 23 is prevented from moving parallel to the contact glass 51 by the supporting members 24 fitted in the holes 22*b*.

Further, the attachment members 22 are respectively secured to the fixing portions 41 provided on the document original discharge tray A3 by means of fixing screws 26 extending through holes formed on both sides of the hole 22*b*. Thus, the document original transporting unit A1 is mounted on the document original discharge tray A3 in a vertically suspended state with its lateral, forward and backward movement (or its movement parallel to the contact glass 51) being restricted. When the mounting members 22 are secured to the fixing portions 41 of the document original discharge tray A3, the projections 20 formed on the bottom face of the document original transporting unit A1 respectively extend through holes 44 formed in the document original discharge tray A3.

The document original discharge tray A3 with the document original transporting unit A1 thus mounted thereon is placed atop the image reading device 50, as shown in FIG. 5. At this time, the projections 21 and the projections 20 extending through the holes 44 abut against the upper surface of the contact glass 51 and the top surface of the image reading device 50, respectively. Thus, the document original transporting unit A1 is supported on the contact glass 51, being positioned in the vertical direction with respect to the contact glass 51. At this time, the compression coil springs 25 are compressed due to the weight of the document original transporting unit A1, the document original tray A2 and the document original discharge tray A3 and, therefore, the projections 20 and 21 are pressed against the top surface of the image reading device 50 and the contact glass 51, respectively.

Thus, the positioning of the document original transporting unit A1 in a horizontal plane with respect to the contact glass 51 is accomplished by the accurate positioning of the document original discharge tray A3 with respect to the image reading device 50. Further, the vertical position and inclination of the document original transporting unit A1 with respect to the contact glass 51 are directly and automatically adjusted by the projections 20 and 21 abutting the top surface of the image reading device 50 and against the contact glass 51, respectively.

The document original tray A2 is attached to the document original transporting unit A1 by bringing the projections 33 provided at the opposite ends of an edge thereof facing the document original transporting unit A1 into engagement with the engaging portions 19 provided on the document original transporting unit A1.

As described above, the document feeder A according to the embodiment of the invention has the document original feeding mechanism for feeding a document original, the document original transporting mechanism for transporting the document original fed by the document original feeding mechanism along the upper surface of the contact glass disposed above the image reading device, and the document original discharging mechanism for discharging the document original transported by the document original transporting mechanism, which are all incorporated in a single unit as the document original transporting unit A1. Hence, once these mechanisms are properly positioned with respect to each other in the assembling of the document original transporting unit A1, the mounting of the document original transporting unit A1 on the image reading device can be achieved simply by properly positioning the unit A1 with respect to the image reading device. This ensures easy and accurate positioning of the document feeder for the mounting thereof. Further, the optical reading system disposed below the contact glass and the document original transporting section disposed above the contact glass can be precisely aligned with each other. The precise alignment is a critical factor deciding the degree of integrity of an image to be acquired by the image reading device.

Further, the invention is advantageous in that all the mechanisms responsible for a series of document original transporting operations are incorporated in a single unit as the document original transporting unit A1, and that the document original tray A2 and the document original discharge tray A3 each inevitably having a large size are constructed as separate units. More specifically, the document original transporting mechanism having a reduced size (which is a feature of document feeders of the type applicable to the browse-type image reading device) is detachable as a compact unit from the document feeder. This ensures easier maintenance of the document original transporting mechanism.

In mounting the document original transporting unit A1 on the contact glass above the image reading device, the document original transporting unit A1 is supported by the base provided on the image reading device for parallel positioning thereof with respect to the contact glass, while supported by the upper surface of the contact glass for vertical positioning thereof. This ensures easy and precise positioning of the document original transporting unit with respect to upper surface of the contact glass.

While the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

This application claims priority benefits under 35 USC Section 119 of Japanese Patent Application No. 8-304643 filed in the Japanese Patent Office on Nov. 15, 1996, the entire disclosure of which is incorporated herein by reference.

What is claimed is:

1. A document feeder to be mounted on an image reading device having a stationary optical system disposed under a contact glass, the document feeder comprising:

a base disposble on top of the reading device;

a document original plate for holding thereon a document original;

a document original feeding mechanism for feeding the document original from the document original plate onto the contact glass;

a document original transporting mechanism for transporting the document original fed by the document original feeding mechanism along an upper surface of the contact glass;

a document original discharging mechanism for discharging the document original transported by the document original transporting mechanism;

a document original discharge plate for receiving the document original discharged by the document original discharging mechanism; and a unit body for integrally supporting the document original feeding mechanism, the document original transporting mechanism and the document original discharging mechanism in the form of a single unit, the unit body being connectable to the base disposable atop the image reading device and having a positioning abutment portion which may be extended through the base to abut against a top of the image reading device.

2. A document feeder as set forth in claim 1, wherein the unit body is constructed to be detachable from the base atop the image reading device.

3. A document feeder as set forth in claim 1, wherein the unit body is positioned in a plane parallel to the surface of the contact glass with the aid of the base atop the image reading device.

4. A document feeder as set forth in claim 3, wherein the base and the document original discharge plate are integrally formed.

5. A document feeder as set forth in claim 3, wherein the abutment portion is adapted to abut against the upper surface of the contact glass, the document feeder further comprising:

an attachment mechanism for attaching the unit body in a suspended state above the base; and a biasing mechanism for biasing the unit body toward the contact glass to press the abutment portion against the contact glass when the document feeder is mounted on the image reading device.

6. A document feeder as set forth in claim 5, wherein the attachment mechanism includes a mechanism for positioning the unit body on the base in a plane parallel to the contact glass.

7. A document feeder as set forth in claim 1, wherein the abutment portion is adapted to abut against the upper surface of the contact glass for positioning the unit body in a direction perpendicular to the surface of the contact glass.

8. A document feeder as set forth in claim 1, wherein the document original plate is detachable from the unit body.

9. A document feeder as set forth in claim 1, wherein the document original discharge plate is detachable from the unit body.

10. A document feeder as set forth in claim 1, wherein the unit body includes:

a feeding port for receiving a leading edge of the document original placed on the document original plate;

a document original feeding path extending from the feeding port to the upper surface of the contact glass; and a document original discharging path extending from the upper surface of the contact glass to a discharge port facing the document original discharge plate.

11. A document feeder as set forth in claim 10, wherein the document original feeding mechanism, the document original transporting mechanism and the document original discharging mechanism are constituted by a plurality of transportation rollers disposed in a spaced relation along the path extending from the feeding port to the discharge port.

* * * * *